US007353584B2

(12) United States Patent
DeFreese et al.

(10) Patent No.: US 7,353,584 B2
(45) Date of Patent: Apr. 8, 2008

(54) DECK TOOL

(75) Inventors: Michael DeFreese, Columbia, SC (US); Allan A. Abbata, Lexington, SC (US)

(73) Assignee: Consolidated Systems, Inc., Columbia, SC (US)

( * ) Notice: Subject to any disclaimer, the term of this patent is extended or adjusted under 35 U.S.C. 154(b) by 0 days.

(21) Appl. No.: 11/583,402

(22) Filed: Oct. 18, 2006

(65) Prior Publication Data

US 2008/0028595 A1 Feb. 7, 2008

Related U.S. Application Data

(60) Provisional application No. 60/727,942, filed on Oct. 18, 2005.

(51) Int. Cl.
*B23P 23/00* (2006.01)
*B23P 19/00* (2006.01)

(52) U.S. Cl. ..... 29/566.1; 29/33 K; 29/509; 29/243.5; 29/243.58; 72/326

(58) Field of Classification Search ..... 29/566, 29/566.1, 50, 33 K, 243.5, 243.58, 897.3, 29/509, 521, 505, 513; 72/325–326
See application file for complete search history.

(56) References Cited

U.S. PATENT DOCUMENTS

| | | | | | |
|---|---|---|---|---|---|
| 1,430,807 | A * | 10/1922 | Hoffmann | 72/409.01 |
| 2,874,666 | A * | 2/1959 | Thor | 29/243.5 |
| 3,641,729 | A * | 2/1972 | Irvin | 29/521 |
| 3,714,688 | A * | 2/1973 | Olson | 72/325 |
| 3,914,845 | A * | 10/1975 | Olsson | 29/243.5 |
| 5,878,617 | A * | 3/1999 | Parker | 72/409.12 |
| 6,212,932 | B1 * | 4/2001 | Parker | 72/325 |
| 6,397,469 | B2 * | 6/2002 | Parker | 29/897.3 |
| 6,990,781 | B2 * | 1/2006 | Sundstrom | 29/521 |

* cited by examiner

*Primary Examiner*—Erica Cadugan
(74) *Attorney, Agent, or Firm*—Sara A. Centioni; Nexsen Pruet, LLC.

(57) ABSTRACT

A tool that can be used to join adjacent deck sections along their side edges. The tool can include a handle portion that is used by the operator to maneuver the tool and a cutting and folding assembly that is at the base of the tool. The cutting and folding assembly can further include a driven punch that operates with a stationary die to simultaneously cut and shear the horizontal elements of a side lap, then folds those elements downward about 90 degrees from their original horizontal position, hemming the two individual side laps into a flattened vertical seam.

11 Claims, 6 Drawing Sheets

B–B

A–A

DECK TOOL

CROSS REFERENCE TO RELATED APPLICATIONS

The present application claims the benefit of priority of U.S. Provisional Application No. 60/727,942 filed Oct. 18, 2005.

STATEMENT REGARDING FEDERALLY SPONSORED RESEARCH OR DEVELOPMENT

Not applicable.

REFERENCE TO A SEQUENCE LISTING, A TABLE, OR A COMPUTER PROGRAM LISTING COMPACT DISC APPENDIX

Not Applicable.

BACKGROUND OF INVENTION

The present invention relates to an tool for joining metal decks.

In the commercial and residential construction industry, various means and techniques are employed to enhance the performance of construction components. Metal decks are among these construction components. More and more structures are including deck panels, profiles or sections made of metal, such as steel. These components can provide structural support in flooring and roofing systems, as well as others.

Often, the dimensions required by a construction project necessitate that a plurality of metal decks be joined in side-by-side relation so that the decks can span a designated area. In this case, the side edges of the metal decks can be used to enhance the diaphragm performance and possibly composite action of the adjoined deck sections. As used herein, "composite action" refers to the interaction between a deck and concrete or similar materials. In particular, the side edges of the adjacent decks can be overlapped to provide a "side lap." Additionally, a portion of the side lap can be folded so as to further enhance the potential composite action, as well as to provide an alignment feature.

Forming these types of side laps can prove challenging and time consuming. Accordingly, there exists a need to provide an apparatus or tool for preferably joining adjacent deck sections that is effective and simple to operate.

SUMMARY OF INVENTION

The following presents a simplified summary of the invention in order to provide a basic understanding of some aspects of the invention. This summary is not an extensive overview of the invention. It is not intended to identify key or critical elements of the invention or to delineate the scope of the invention. Its sole purpose is to present some concepts of the invention in a simplified form as a prelude to the more detailed description that is presented later.

The present invention includes a tool that can be used to join adjacent deck sections along their side edges. In one embodiment of the present invention, adjacent deck sections are provided having a side lap configuration including a first side edge in the shape of a seven (7) or an inverted "L" that is overlapped by a second side edge having similar configuration. In particular, each deck section can include side edges or webs with upturned flanges that include horizontal elements in the shape previously described. This configuration can be referred to as a "hidden side lap." The tool of the present invention can be employed to fasten the adjacent deck sections together by cutting and folding the deck sections along their hidden side lap. There can be other types of side laps having different configurations, however, that can be cut and folded by the tool of the present invention.

In particular, the tool can include a handle portion that is used by the operator to maneuver the tool and a cutting and folding assembly that is at the base of the tool. The cutting and folding assembly can further include a driven punch that operates with a stationary die to simultaneously cut and shear the horizontal elements of a side lap, then folds those elements downward about 90 degrees from their original horizontal position, hemming the two individual side laps into a flattened vertical seam. Although various shapes can be made through this cutting and folding, in one embodiment of the present invention, a trapezoidal shape results from the use of the tool. In operation, the tool can fasten two or more metal deck panels together at the side lap so that relative vertical or horizontal displacement is limited.

One feature of the tool is the cutting and folding assembly that creates the joint, and yields two connected deck panels, sections or profiles. Through the use of a driven punch that is operatively connected to a stationary die, a side lap between two deck sections can be simultaneously cut and folded. The tool, therefore, can form an effective keyed and locked joint.

Another feature is the trapezoidal shape of the joint the tool can create on the horizontal elements of the sidelaps. The shape can be developed from shearing the horizontal elements at angles that produce a joint with the cut side larger than the non-cut side. When the joint is used in systems with concrete applied to the deck, the trapezoidal shape on the horizontal elements allows for complete interlock between the concrete and the steel, forming a fully composite slab.

Another feature of the tool is its creation of two trapezoidal shaped vertical elements from the original hidden sidelap configuration. The two vertical elements, one from each deck panel, can be formed by folding the two cut horizontal elements downward. The trapezoidal shape of the vertically aligned cut metal can limit the vertical translation of deck fastened in this manner.

Yet another feature of the tool is the manner in which it folds and hems the joint minimizing the horizontal relative displacement of attached metal decks. Once the tool forms the joint, the deck is blocked from translating laterally (horizontally) relative to each other.

Another feature is the versatility of the tool to work with multiple deck profiles. Any profile that utilizes the hidden (inverted "L") sidelap configuration, from about a 22 gauge (0.0280 in) to about a 14 gauge (0.0710) thickness, can be connected with the present invention. These ranges can expand depending on the particular features of the tool.

Others features of the tool include the height of controls, (between about 36" and about 42") to allow a user to attach the deck from a standing position, and the weight of the tool, (below about 50 lbs) so that it can be managed and operated by one user. These are optional features that can be included or not depending on the size and strength of the operator.

These features and other advantages of the present invention will be apparent to those skilled in the art from a careful reading of the Detailed Disclosure of the Invention presented below and accompanied by the drawings.

DETAILED DESCRIPTION OF THE PREFERRED EMBODIMENTS

Figure 1:
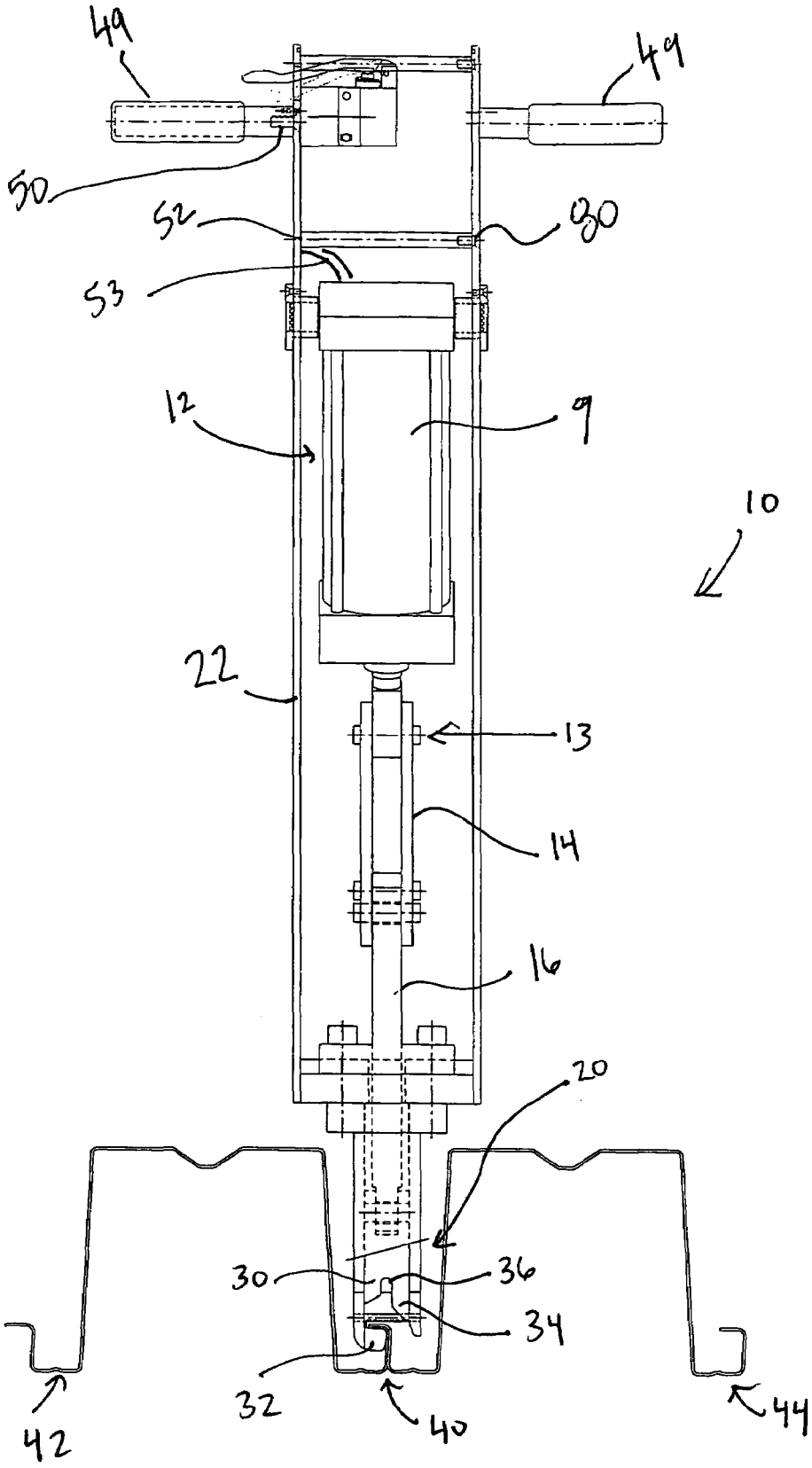
FIG. 1 illustrates a perspective front elevation view of an embodiment of the tool of the resent invention in working position on a typical metal deck with a self-aligning hidden side lap.
Figure 2:
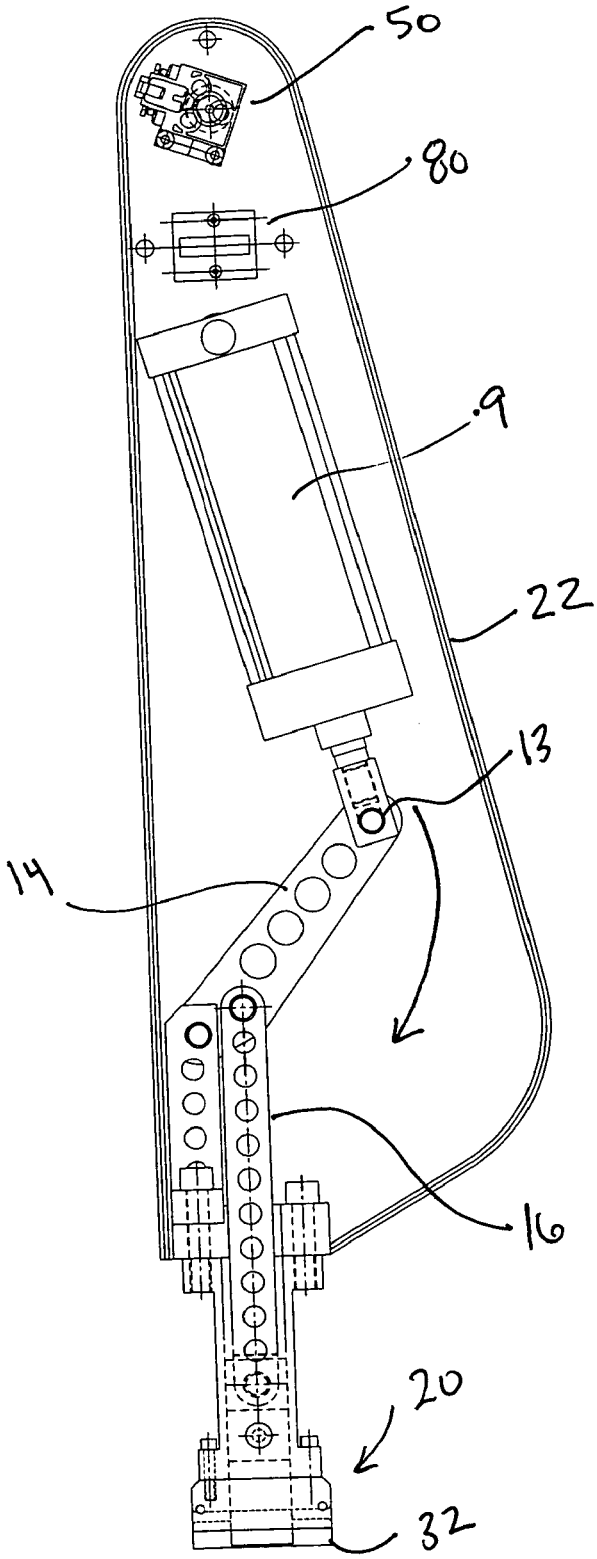
FIG. 2 illustrates a perspective side elevation view of an embodiment of the present invention.

As illustrated in FIGS. 1-2, the tool 10 of the present invention includes a drive means 12 that is operatively connected to a cutting and folding assembly 20. In one embodiment, shown in FIG. 2, the driving means 12 is mechanically connected to a first arm 14 that serves as a lever that rotates about a fulcrum 13. The first arm 14 is mechanically connected to a second arm 16 that can serve to push the cutting and folding assembly 20 vertically downward. This configuration is useful in providing additional force to drive the cutting and folding assembly 20. Optionally, the tool can include a frame 22 to enclose the various components of the tool 10 and to provide support if needed. This frame 22 can also provide a safety feature to the tool 10.

The tool 10 can also include a trigger 50. Although many types of triggers can be employed, the trigger 50 of the present invention can be a double action piston, so that pulling the trigger 50 activates the drive means 12 so as to initiate cutting and folding, and releasing the trigger deactivates it. Further, the driving means 12 can be a pneumatic pump cylinder, or any other suitable driving means, including a mechanical drive, that can provide a force to the first and second arms 14, 16. If a pneumatic pump is employed, the tool 10 includes a source of air 52 and an air hose 53 connected to the pneumatic cylinder.

The cutting and folding assembly 20 can be in the form of a punch and die. In one embodiment, shown in FIG. 1, the assembly 20 includes a cutting die 30 and an alignment flange 32. The cutting die 30 further includes an alignment blade 34 and a folding groove 36.

A number of different types of deck sections, profiles and panels can be joined with the tool 10 of the present invention. For descriptive purposes, however, deck sections having a particular side lap configuration are shown in FIG. 1, and more particularly in FIGS. 5-6. The illustration of the deck sections and side lap is made merely for completeness to place the deck joint and tool 10 into context. Therefore, many variations can be made to both the shape of the deck sections, as well as to the shape of the cutting and folding assembly 20 depending on structural and/or aesthetic preferences.

As illustrated, a typical side lap 40 is formed by a first deck section 42 that is in juxtaposed relation to a second deck section 44. These deck sections 42, 44 each include complementary upturned flanges 43, 43', respectively, having horizontal elements or ledges 45, 45', respectively. When the deck sections 42, 44 are in place, the upturned flanges 43, 43' have the shape of a seven "7" or an inverted "L." Accordingly, the upturned flange 43 of the first deck section 42 is overlapped by the upturned flange 43' of the second deck section 44. The side lap 40, also called hidden side lap, is created by this juxtaposed relation.

In operation, the tool 10 can be placed over the side lap 40 region of the adjacent metal deck sections 42, 44. The alignment flange 32 of the cutting and folding assembly 20 then can be used to align both the side lap 40 arrangement and the tool 10 so that an ideal positioning is achieved for the cutting and folding of the side lap 40. The positioning of the alignment flange 32 is shown more particularly in FIG. 4B. To initiate the cutting and folding, an operator will pull or press the trigger 50, which then activates the driving means 12. If a pneumatic pump is employed, upon activating the trigger 50, air fills a pneumatic pump cylinder 13 and the first arm 14 of the tool is moved downward. More specifically, the first arm 14 will move downward in roughly an arch. This motion causes the second arm 16 to also move downward and engage the cutting and folding assembly 20.

Figure 3A:
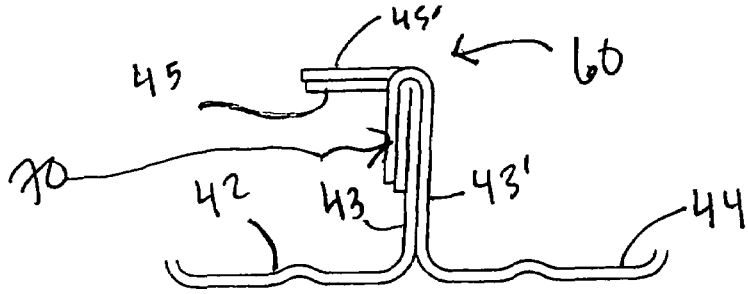
FIG. 3A illustrates a cross-sectional view taken from Line A-A of FIG. 3B of an embodiment of the joint created by the tool of the present invention.
Figure 3B:
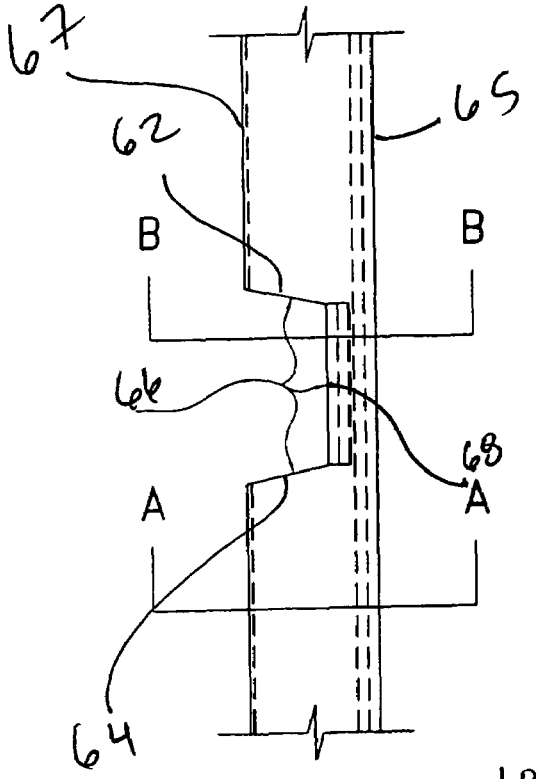
FIG. 3B illustrates a top view of an embodiment of the joint created by the tool of the present invention.
Figure 3C:
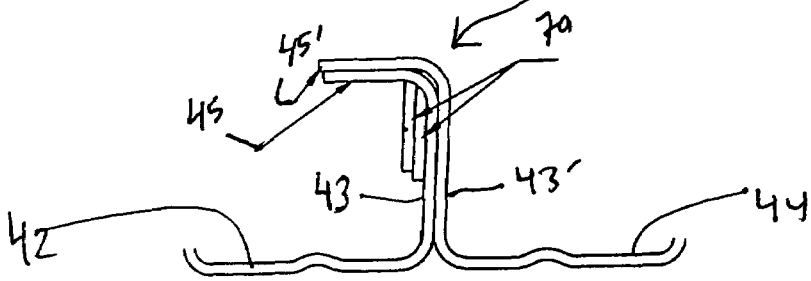
FIG. 3C illustrates a cross-sectional view taken from Line B-B of FIG. 3B of an embodiment of the joint created by the present invention.

Similar to a press, the cutting and folding assembly 20 is punched onto the side lap 40 so as to form a joint 60 (shown in detail in FIGS. 3A-3C) between the first and second deck sections 42, 44. This action will then cause the second arm 16 to move downward and engage the cutting and folding assembly 20. Specifically, a punch 30 will be driven vertically downward through the stationary die 32 by second arm 16. As shown in FIGS. 3A-3C, when the cutting and folding assembly 20 is forced down onto the side lap region 40, the punch 30 and cutting die 32 will form a first and a second cut 62, 64. Simultaneously to the cutting, the folding groove 36 of the punch 30 will bend and form a fold 68 in the side lap at the cutting area 66 between the first and second cuts. More particularly, the punch 30 simultaneously cuts and shears the horizontal elements 45, 45', of the side lap 40, and then folds the elements downward about 90 degrees from their original horizontal position, thus hemming the two individual elements into a flattened vertical seam 70. To maintain the alignment of side lap 40 during the cutting, and folding, the alignment blade 34 is moved down the side lap 40 on the opposite side or non-cuffing side, 65, to the cutting and folding side, 67.

Figure 4A:
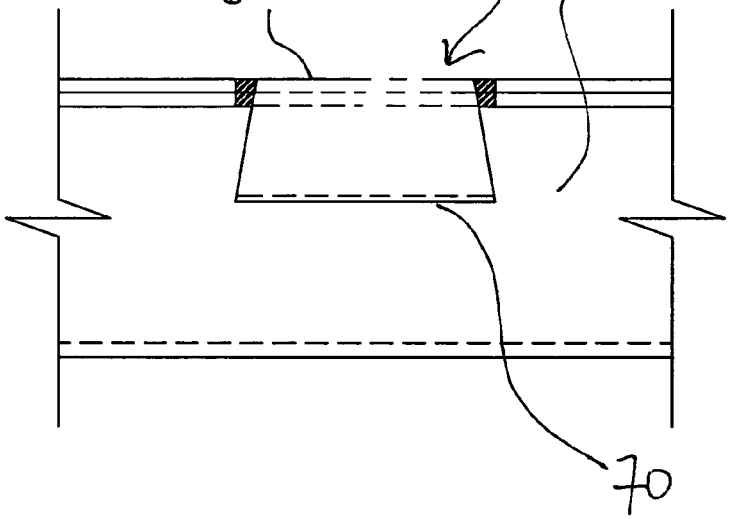
FIG. 4A illustrates a elevation view of an embodiment of the joint created by the present invention.
Figure 4B:
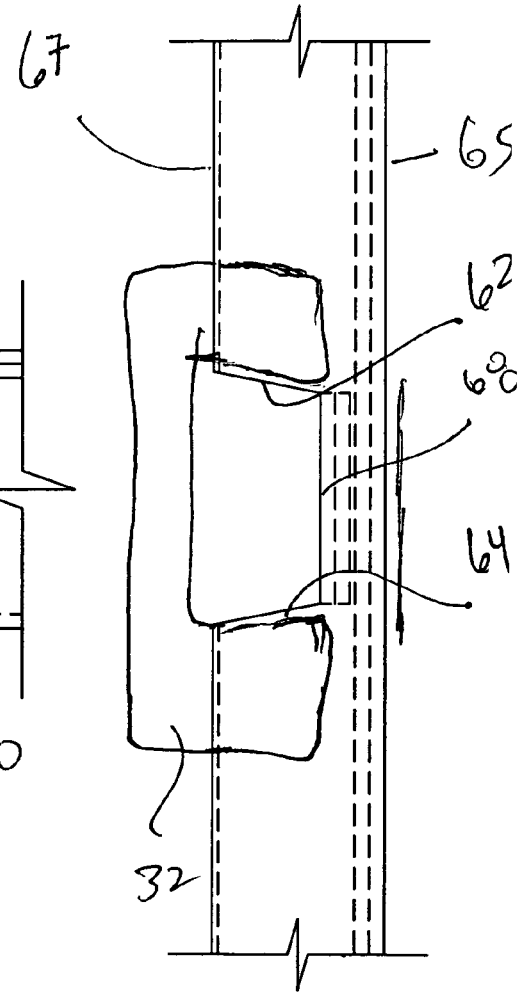
FIG. 4B illustrates a top view of an embodiment of the joint created by the present invention in relation to an alignment member of the tool of the present invention.

Although various joint shapes can be made through this cutting and folding, in one embodiment of the present invention, a trapezoidal shape results from the use of the tool 10. This shape is shown in FIGS. 3B, and 4A-4B. As shown, the first and second cuts 62, 64, made by the die 30 are angled towards each other and converge at the fold 68 of the joint 60. Accordingly, when the horizontal elements 43, 43', are in the folded position, as shown in FIG. 4A, the result is a seam 70 that is about trapezoidal in shape.

Figure 5:
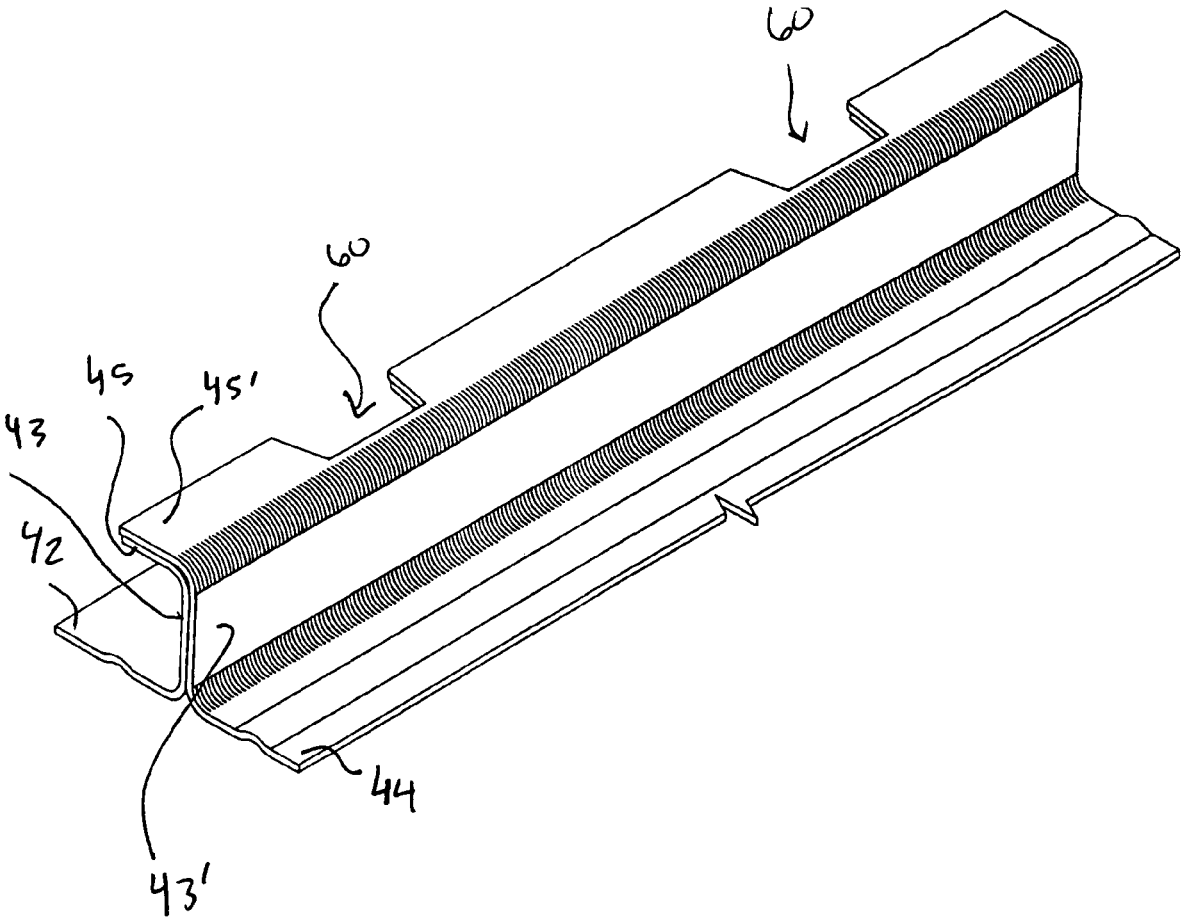
FIG. 5 illustrates an isometric view of an embodiment of the non-cut side of the joint created by the present invention.
Figure 6:
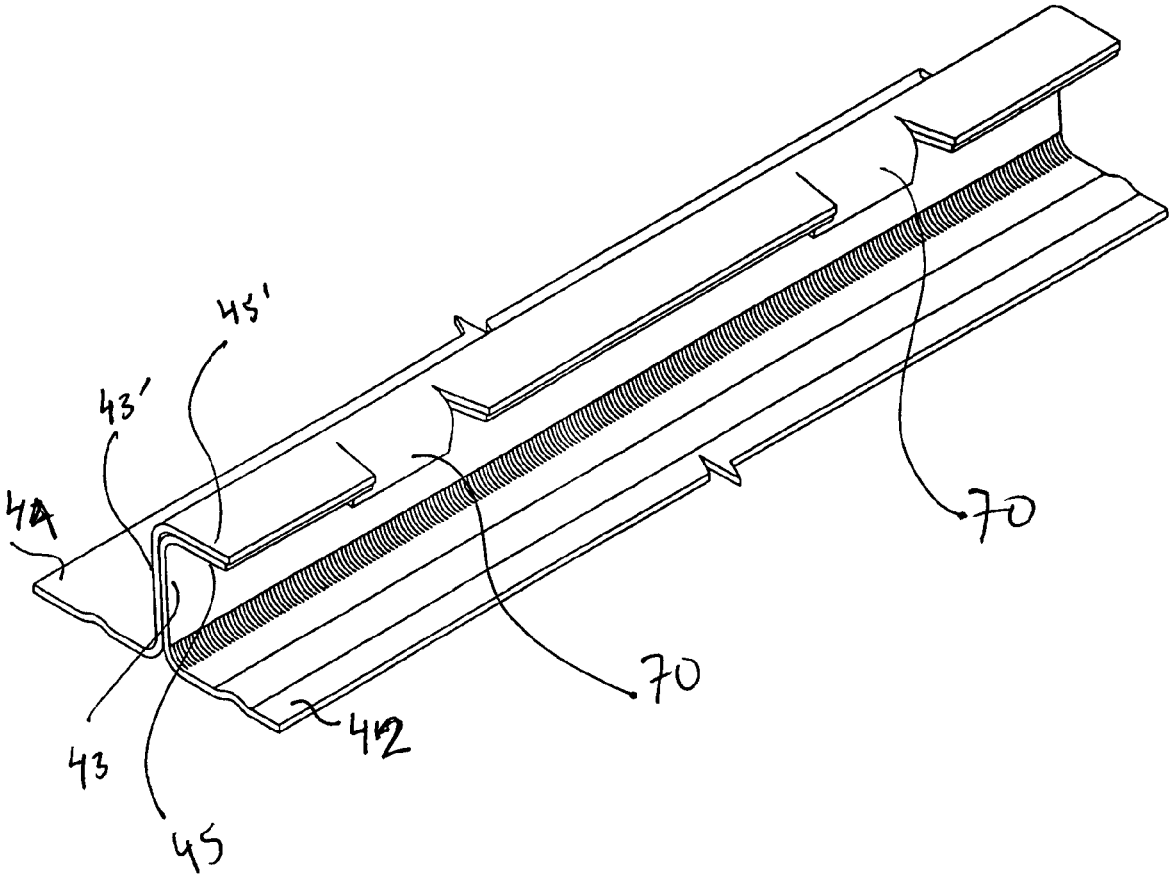
FIG. 6 illustrates an isometric view of an embodiment of the cut side of the joint created by the present invention.

Depending on the length of the metal deck sections, multiple joints 60 may have to be made with the tool 10 of the present invention. By way of illustration, FIGS. 5 and 6 show a finished and jointed side lap, both from the cutting and folding side and the non cutting and folding side. If multiple joints 60 are needing to be made, another optional feature can be a counter 80 (shown in FIG. 1). This feature can assist the operator in positioning the tool 10 along the side lap of the metal decks. From each joint made, an operator can employ the counter to position the tool for the next or subsequent joint. For example, if one needs cuts and fold along ever 6 inches, the counter 80 can assist the operator in spacing out the joints in a convenient and effective way.

Those skilled in the art of deck sidelaps will recognize that many substitutions and modifications can be made in the forgoing preferred embodiments without departing from the spirit and scope of the present invention.

What is claimed is:

1. A tool for joining metal decks, comprising:

a driving means that is operatively connected to a first arm, a second arm and a cutting and folding assembly including a cutting punch, a folding groove, and an alignment flange, wherein said driving means is connected to said first arm, said first arm pivoting about a fulcrum to drive said second arm to linearly move the cutting punch and folding groove relative to the alignment flange in a straight line to cut and fold flaps of the decks to thereby join the decks.

2. The tool as recited in claim 1, further comprising a trigger that activates said driving means.

3. The tool as recited in claim 2, wherein said trigger is a double action trigger.

4. The tool as recited in claim 1, further comprising a frame that encases said driving means, said first arm, and said second arm.

5. The tool as recited in claim 4, further comprising a counter connected to said frame.

6. The tool as recited in claim 1, wherein said driving means is a pneumatic pump having a pneumatic cylinder.

7. The tool as recited in claim 6, further comprising an air source that is operatively connected to said pneumatic cylinder.

8. The tool as recited in claim 1, wherein said alignment flange of said cutting and folding assembly is in the form of a die.

9. The tool as recited in claim 1, wherein said cutting punch includes blades that are angled relative to one another.

10. The tool as recited in claim 1, wherein said cutting and folding assembly includes an alignment blade.

11. The tool as recited in claim 1, wherein said folding groove is dimensioned to receive a side lap between first and second metal deck sections.

* * * * *

UNITED STATES PATENT AND TRADEMARK OFFICE

CERTIFICATE OF CORRECTION

PATENT NO. : 7,353,584 B2
APPLICATION NO. : 11/583402
DATED : April 8, 2008
INVENTOR(S) : DeFreese et al.

It is certified that error appears in the above-identified patent and that said Letters Patent is hereby corrected as shown below:

Column 3, line 5, “resent” should be changed to --present--

Column 3, line 11, “A-A” should be changed to --B-B--

Column 3, line 16, “B-B” should be changed to --A-A--

Column 4, line 29, “arch” should be changed to --arc--

Signed and Sealed this

Eighth Day of July, 2008

JON W. DUDAS
*Director of the United States Patent and Trademark Office*